US008774417B1

(12) United States Patent
Cabot et al.

(10) Patent No.: US 8,774,417 B1
(45) Date of Patent: Jul. 8, 2014

(54) SURROUND AUDIO COMPATIBILITY ASSESSMENT

(75) Inventors: Richard C. Cabot, Lake Oswego, OR (US); Matthew Sammis Ashman, Seattle, WA (US)

(73) Assignee: XFRM Incorporated, Lake Oswego, OR (US)

( * ) Notice: Subject to any disclaimer, the term of this patent is extended or adjusted under 35 U.S.C. 154(b) by 261 days.

(21) Appl. No.: 12/898,703

(22) Filed: Oct. 5, 2010

Related U.S. Application Data

(60) Provisional application No. 61/248,880, filed on Oct. 5, 2009.

(51) Int. Cl.
*H04R 5/00* (2006.01)

(52) U.S. Cl.
USPC ..... 381/18

(58) Field of Classification Search
CPC ..... H04R 29/008; H04R 5/00; H04S 2400/03
USPC ..... 381/1, 56, 17–23, 55, 58, 59; 700/94; 704/500, 503
See application file for complete search history.

(56) References Cited

U.S. PATENT DOCUMENTS

| | | | | |
|---|---|---|---|---|
| 4,251,688 | A * | 2/1981 | Furner | 381/18 |
| 5,210,796 | A * | 5/1993 | Hirabayashi et al. | 381/12 |
| 5,450,490 | A * | 9/1995 | Jensen et al. | 380/253 |
| 5,751,819 | A * | 5/1998 | Dorrough | 381/56 |
| 5,946,352 | A | 8/1999 | Rowlands et al. | |
| 6,005,948 | A * | 12/1999 | Maeda | 381/18 |
| 6,580,746 | B2 * | 6/2003 | Challa et al. | 375/130 |
| 7,146,313 | B2 | 12/2006 | Chen et al. | |
| 7,313,517 | B2 | 12/2007 | Beerends et al. | |
| 7,330,552 | B1 * | 2/2008 | LaMance et al. | 381/18 |
| 7,391,870 | B2 * | 6/2008 | Herre et al. | 381/23 |
| 7,394,903 | B2 * | 7/2008 | Herre et al. | 381/23 |
| 7,450,727 | B2 * | 11/2008 | Griesinger | 381/119 |
| 8,082,157 | B2 * | 12/2011 | Pang et al. | 704/500 |
| 8,200,351 | B2 * | 6/2012 | Kurniawati et al. | 700/94 |
| 8,363,855 | B2 * | 1/2013 | Griesinger | 381/119 |
| 2004/0032960 | A1 * | 2/2004 | Griesinger | 381/104 |
| 2005/0074127 | A1 * | 4/2005 | Herre et al. | 381/20 |
| 2005/0157883 | A1 * | 7/2005 | Herre et al. | 381/17 |
| 2005/0259828 | A1 * | 11/2005 | Van den Berghe | 381/23 |
| 2006/0009225 | A1 * | 1/2006 | Herre et al. | 455/450 |
| 2007/0121953 | A1 * | 5/2007 | Wei | 381/22 |
| 2007/0172071 | A1 * | 7/2007 | Mehrotra et al. | 381/23 |
| 2009/0028360 | A1 * | 1/2009 | Griesinger | 381/119 |
| 2010/0061558 | A1 * | 3/2010 | Faller | 381/23 |
| 2010/0246832 | A1 * | 9/2010 | Villemoes et al. | 381/17 |

OTHER PUBLICATIONS

Beerends, "Audio Quality Determination Based on Perceptual Measurement Techniques," Applications of Digital Signal Processing to Audio and Acoustics, Chapter I, Ed. Mark Kahrs, Karlheinz Brandenburg, Kluwer Acad. Publ., pp. 1-38, 1998, USA.

(Continued)

*Primary Examiner* — Vivian Chin
*Assistant Examiner* — Leonard M Giannone
(74) *Attorney, Agent, or Firm* — Law Office of Karen Dana Oster, LLC

(57) ABSTRACT

A method for performing a surround audio compatibility assessment on a plurality of original surround channels is described herein. A surround audio compatibility assessment system accepting original surround signals is also described herein.

23 Claims, 10 Drawing Sheets

(56) References Cited

OTHER PUBLICATIONS

Brice, Richard, "A New Monitoring Tool for 5.1 Audio," Website, www.richardbrice.net/5.1_monitoring_tool.htm, 15 pages, at least as early as Oct. 10, 2010.

Cabot, Richard C., "Automated Assessment of Surround Sound," Audio Engineering Society Convention Paper Presented at the 127th Convention, Oct. 9-12, 2009, 8 pages, New York, NY, USA.

International Telecommunications Union (ITU), Recommendation ITU-R BS.1387-1, Method for Objective Measurements of Perceived Audio Quality, 100 pages, 1998-2001, Switzerland.

International Telecommunications Union (ITU), Recommendation ITU-R BS.1770-1, Algorithms to Measure Audio Programme Loudness and True-peak Audio Level, 19 pages, 2006, Switzerland.

Jesteadt et al., "Forward Masking as a Function of Frequency, Masker Level, and Signal Delay," Journal of Acoustical Society of America, 71:950-962, 1982, USA.

Qualis Audio, Sentinel Surround Audio Program Monitor, www.qualisaudio.com, 8 pages, at least as early as 2010, USA.

* cited by examiner

SURROUND AUDIO COMPATIBILITY ASSESSMENT

The present application is an application claiming the benefit under 35 USC Section 119(e) of U.S. Provisional Patent Application Ser. No. 61/248,880, filed Oct. 5, 2009. The present application is based on and claims priority from this application, the disclosure of which is hereby expressly incorporated herein by reference in its entirety.

BACKGROUND OF INVENTION

The present invention is directed to a surround audio compatibility assessment method, system, and apparatus, and more particularly to a surround audio compatibility assessment method, system, and apparatus that is or is associated with an audio monitor.

"Monophonic sound" (also referred to as "mono") is the reproduction of an audio source (sound) using a single audio channel that is often centered in the sound field (analogous to a visual field). "Stereophonic sound" (also referred to as "stereo") is the reproduction of an audio source using independent audio channels through a symmetrical configuration of speakers. The term "stereo" is almost exclusively used to describe two-channel (left and right) sound, although technically more than two channels could be used. "Surround sound" (also referred to as "surround") encompasses a range of techniques for reproduction of an audio source with audio channels reproduced using multiple discrete speakers. A surround sound system creates the illusion of multi-directional sound through speaker placement and signal processing. Surround sound is characterized by a listener location or sweet spot where the audio effects work best, and presents a fixed or forward perspective of the sound field to the listener at this location.

Most modern motion pictures and prime-time television shows (referred to jointly as "media content") are produced in surround. Being the premier audio format, mixing engineers understandably put their attention on how their content sounds in surround. Though most theaters will reproduce the media content in surround, the eventual release on DVD for the home market will not experience the same uniformity of presentation. Indeed, as is the case with sound for digital television, the majority of viewers of movie DVDs will experience the audio in stereo and a nontrivial percentage will hear it in mono.

The conversion of surround to stereo or of stereo to mono involves combining channels and algebraically summing their waveforms. Signals that are present in multiple channels may cancel, or partially cancel, when those channels are combined. The degree of cancellation depends on their relative phase, the ratio of their levels prior to combining and any level adjustment introduced in the process of combining. If the original signals have equal amplitudes and are of opposite phase the signal will be completely absent from the combination. The more insidious situation occurs, however, when just one component in a surround mix appears in multiple channels but shifted in phase. This can easily happen when a single source is picked up by multiple non-coincident microphones. When the outputs of these microphones are combined, there will be cancellations and the signal level will be reduced. If this happens to an actor's voice, the dialog can become unintelligible.

Mono compatibility of stereo material has traditionally been monitored with a Lissajous display. The Left and Right channels drive the vertical and horizontal channels of an oscilloscope. Equipment specifically designed for audio monitoring (e.g. a sound "monitoring product" or "audio monitor") typically will rotate the display counterclockwise by 45 degrees to make the left channel appear as a diagonal line tilting toward the upper Left and the Right channel appear as a line tilting toward the upper right. Interpretation of such a display requires experience associating the various shapes with circumstances in which audio has experienced cancellations when mixed to mono.

Many manufacturers have eliminated the graphical display in their sound "monitoring product" or "audio monitor" by using "correlation" meters. These correlation meters multiply the Left and Right channels together and average the result, creating an indicator that is positive when the channels are in-phase and negative when they are out-of-phase. This is usually normalized by the channel levels, creating an indicator scaled between +1 and −1. A good stereo signal will hover near zero, a good mono signal will be positive. Indications that go very negative represent problem content that will cancel when reproduced in mono.

Surround sound "monitoring products" or "audio monitors" also use Lissajous or correlation displays. The first problem in monitoring surround audio compatibility with either type of display is the sheer number of channel pairs involved. Ignoring the LFE (Low Frequency Effects) channel, a 5.1 surround program (e.g. Dolby Digital and DTS (Digital Theater System)) contains 10 channel pairs. A 6.1 surround program has 15 channel pairs. A 7.1 surround program has 21 channel pairs. FIG. 1 shows five speakers 100 each interconnected with channel pairs (e.g. neighboring channel pairs 102 and LF/RF channel pair 104 where "LF" is the left front speaker and "RF" is the right front speaker). This is the five main channels of a 5.1 surround program. The LFE is not shown in this figure. The 6.1 and 7.1 surround programs would have a similar pattern in which arrows connect all channel pairs, but the resulting diagram would be extremely busy. Many commercial surround sound monitoring products only analyze neighboring channel pairs that are shown in FIG. 1 as the outside double arrows 102. Other commercial surround sound monitoring products add the LF/RF channel pair 104.

The challenge for the user is watching numerous correlation meters or Lissajous patterns simultaneously. Vendors of such tools have used various schemes to pack these displays onto a single XY display. All of these schemes take advantage of the redundancy evident in the four quadrants of the Lissajous display. Since the lower half of a Lissajous display offers no additional information compared to the upper half, the display may be truncated or folded at the horizontal axis.

Monitoring audio signals through a broadcast chain has long been a job for humans, skilled in audio, well versed in the potential problems and attentively listening to the program on an accurate reproduction system. Particularly in television broadcast, such people are scarce. The recent explosion of television channels and delivery systems has drastically increased the number of programs to be monitored. The shift to surround sound has added additional failure mechanisms such as front/rear channel reversal and compatibility with stereo and mono reproduction. Economic realities have further constrained both the availability of skilled personnel and the acoustic quality of their monitoring environment while reducing the time available to accomplish the task.

The issues facing professionals and organizations creating and delivering surround programs include, but are not limited to: mixing and monitoring surround is a far more complex and challenging task than it is for stereo programs as there are many more opportunities for error; budgets, both financial and time, are shrinking; personnel are expensive and skilled personnel are very expensive; people get tired and bored so when things don't go wrong often (hopefully), vigilance is difficult to maintain; and record keeping is important for post-mortem analysis and for assessing financial accountability, but people hate to keep records.

BRIEF SUMMARY OF THE INVENTION

The present invention is directed to a surround audio compatibility assessment method, system, and apparatus that automates the process of monitoring audio signals through a broadcast chain by substituting an intelligent device for the overworked, expensive, drudgery avoiding humans previously used to accomplish the task.

Described herein is a method for performing a surround audio compatibility assessment on a plurality of original surround channels. The method includes the following steps: downmixing the original surround channels into Left and Right stereo channels and into a mono channel; measuring a power spectrum of each of the original surround channels; measuring a power spectrum of each of the Left stereo channel, the Right stereo channel, and the mono channel; comparing a combined power spectra of the original surround channels with a combined power spectra of the Left stereo channel, the Right stereo channel, and the mono channel; and displaying the results of the previous steps.

In one preferred method for performing a surround audio compatibility assessment on a plurality of original surround channels the step of downmixing the original surround channels into Left and Right stereo channels and into a mono channel further comprising the steps of is replaced by two steps: downmixing the original surround channels into Left and Right stereo channels; and downmixing the Left and Right stereo channels into a mono channel.

In one preferred method for performing a surround audio compatibility assessment on a plurality of original surround channels the step of downmixing the original surround channels into Left and Right stereo channels and into a mono channel further includes the step of downmixing using an end-user's reproduction equipment's downmix equations.

In one preferred method for performing a surround audio compatibility assessment on a plurality of original surround channels, an inequality between the combined power spectra of the original surround channels and the combined power spectra of the Left stereo channel, the Right stereo channel, and the mono channel indicates a problem in compatibility.

The present invention may also be a surround audio compatibility assessment system accepting original surround signals.

Preferred embodiments of the present invention address the fundamental problem(s) of prior art schemes. Preferred embodiments of the present invention take into account, the user's needs and wants. For example, the user doesn't really want to know about the phase relationships anyway. The user wants to know if the content will sound the same in stereo and mono as it does in surround. Preferred embodiments of the present invention directly address one or more of the user's needs and wants.

The foregoing and other objectives, features, and advantages of the invention will be more readily understood upon consideration of the following detailed description of the invention, taken in conjunction with the accompanying drawings.

BRIEF DESCRIPTION OF THE SEVERAL VIEWS OF THE DRAWINGS

The accompanying drawings are incorporated in and constitute a part of this specification.

DETAILED DESCRIPTION OF THE INVENTION

Figure 2:
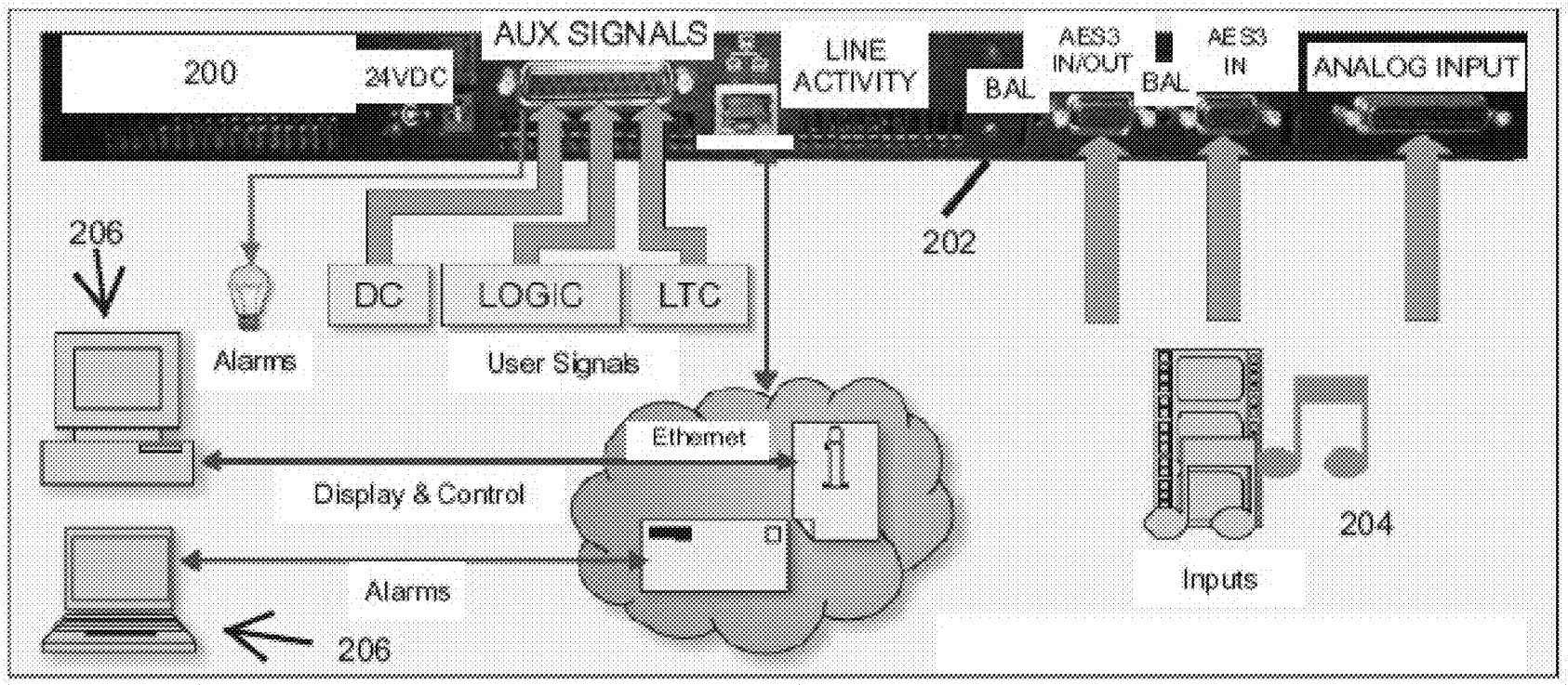
FIG. 2 is a block diagram of an exemplary audio compatibility system associated with an audio monitor and a display.
Figure 3:
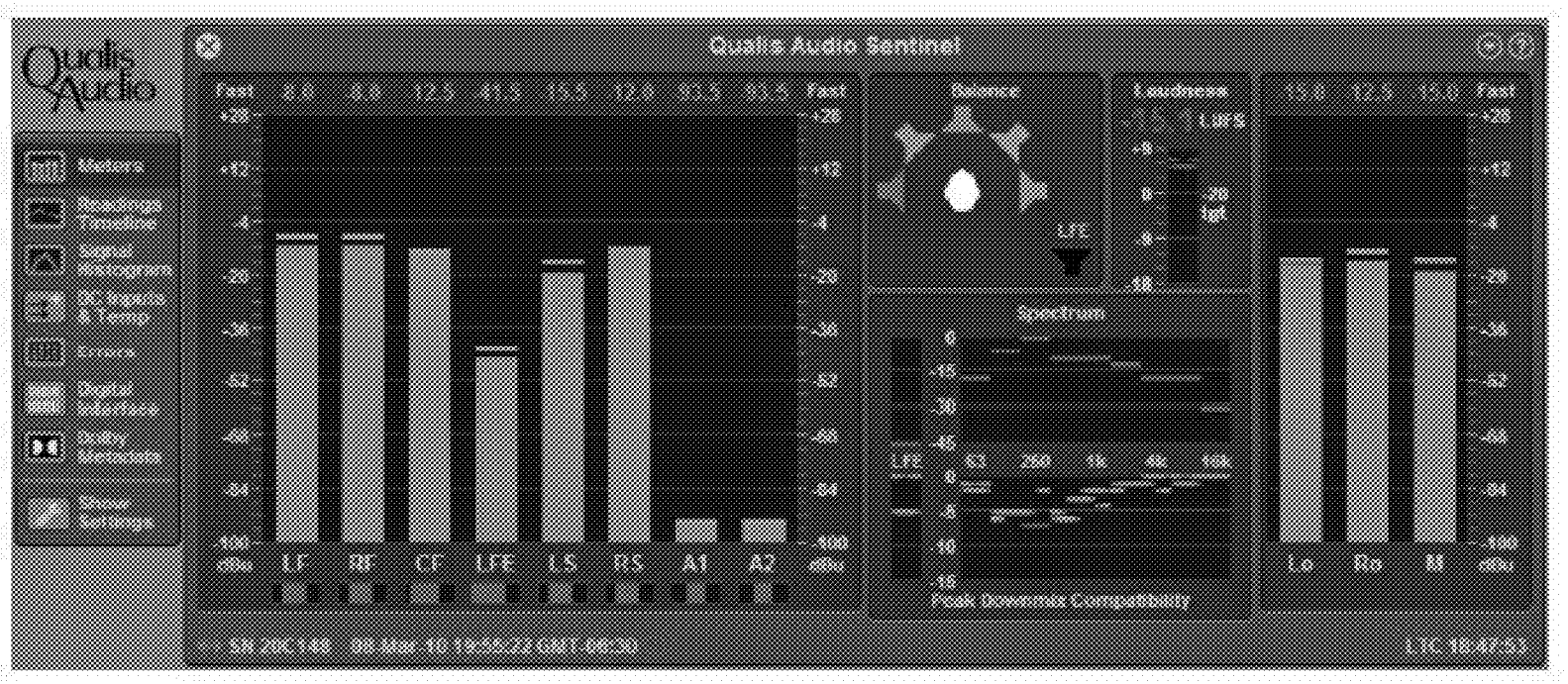
FIG. 3 is a screen shot of an exemplary display from an audio compatibility system and an audio monitor.

As shown in FIG. 2, preferred surround audio compatibility assessment methods, systems, and apparatuses (hereinafter jointly referred to as the "surround audio compatibility assessment system 200," "system 200," or "systems 200") either are, or are associated with a sound monitoring product 202 or audio monitor 202 (terms which can be used interchangeably). An "audio monitor 202" is any device that accepts at least one audio signal as input 204 (through connections such as AES-3 and/or analog input ports) and provides a means for one or more of the following actions: monitoring the input audio signal(s) 204; analyzing the input audio signal(s) 204; manipulating the input audio signal(s) 204; testing the input audio signal(s) 204; and/or otherwise performing actions on the input audio signal(s) 204 that are known or yet to be discovered. The audio monitor 202 is preferably associated with a display and/or input means 206 and/or other means for communicating (e.g. controlling, alerting, or displaying) for purposes such as controlling the system 200, alerting a user, or showing or displaying the results of the monitoring, analyzing, manipulating, and testing. The display and input means 206 may be, for example, one or more remote computers (as shown) and/or an integral display and input means 206. The display may be similar to that shown in FIG. 3. Alternatively, the display may also be a device (e.g. a computer) that receives an alert (e.g. a signal, an email, or a text message). A preferred surround audio compatibility assessment system 200 is associated with the audio monitor 202 and the display and input means 206 such that the preferred surround audio compatibility assessment system 200 assesses the compatibility of the input at least one audio signal 204 and the results of the compatibility assessment is displayed on the display.

The surround audio compatibility assessment system 200 may be implemented as a method (e.g. a series of steps performed by an apparatus such as an audio monitor 202 or a computer), a system (e.g. a processor and/or memory for controlling an audio monitor 202 or a computer), or an apparatus (e.g. an audio monitor 202 or a computer). The audio compatibility assessment system 200 may be embodied in software, firmware, hardware and other forms that achieve the function described herein. The surround audio compatibility assessment system 200 may be a computer program or may be implemented by a computer program that is implemented in a computer program product tangibly embodied in a computer-readable storage device for execution by a computer processor. Although shown distinctly, the audio compatibility assessment system 200, audio monitor 202, and display and input means 206 may be implemented separately or integrally in any combination (e.g. the audio compatibility assessment system 200 may be integral with the display and input means 206 and control the audio monitor 202 remotely).

Preferred surround audio compatibility assessment systems 200 answer the question that most mix engineers really want answered: "Will the audio sound the same in stereo and mono as it does in surround?" These engineers mix in surround know that the surround sounds the way they want it to sound. The engineers, however, do not have the time to listen to the whole mix again in stereo and then again in mono. Accordingly, preferred surround audio compatibility assessment systems 200 measure and provide information on how the stereo and mono presentations compare to the original surround mix (a compatibility assessment).

Figure 1:
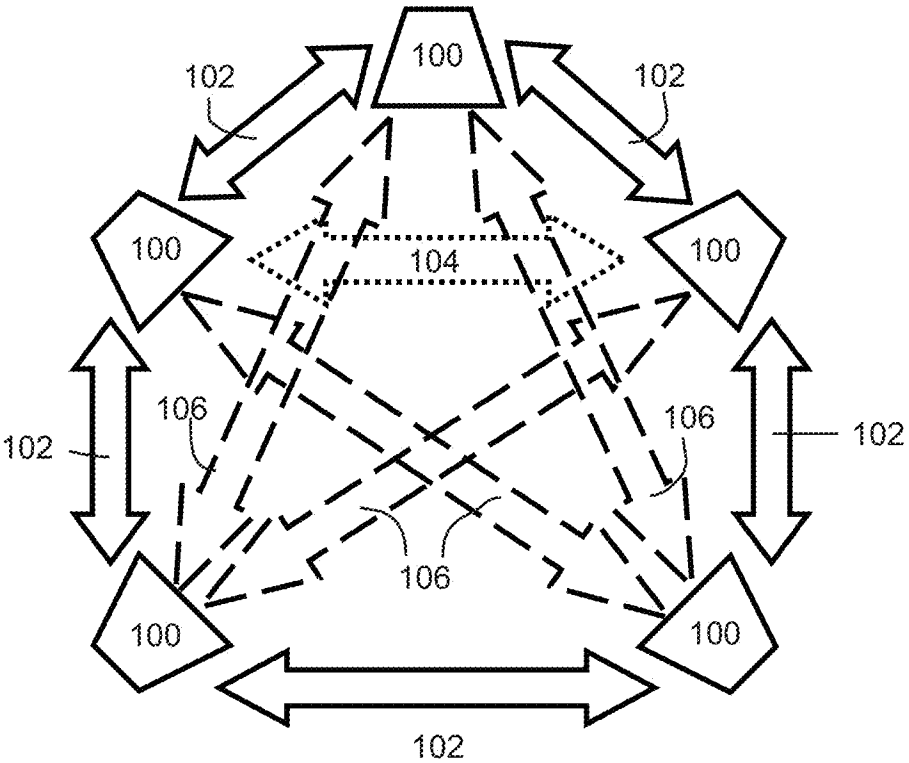
FIG. 1 is a plan view of exemplary speakers and channel pairs in an exemplary surround system.

As set forth in the Background, FIG. 1 shows five speakers 100 each interconnected with channel pairs (e.g. neighboring channel pairs 102 and LF/RF channel pair 104). Many commercial surround sound monitoring products only analyze neighboring channel pairs 102. Other commercial surround sound monitoring products add the LF/RF channel pair 104. Applicants are unaware of any surround sound monitoring products that display the diagonal channel pairs 106. Even without the diagonal channel pairs 106, there are five channel pairs (neighboring channel pairs 102) or six channel pairs (neighboring channel pairs 102 and the LF/RF channel pair 104) to display. "Channels" are the used to describe the paths that carry one or more "signals" and/or "audio signals."

The problems typically encountered in surround production and delivery include, but are not limited to the following: signal path failure or "dead channels"; level issues such as loudness, clipping, "excessive level signals," or "overs"; channel swapping or rearrangement; stereo and mono compatibility; spatial balance; low-frequency effects (LFE) compatibility; hum; and metadata errors and inconsistencies. Some of these problems, such as dead channels, clipping, and loudness are straight forward to monitor and the technology to do so is well understood. Other problems, such as hum or stereo and mono compatibility have, to date, required experienced personnel using specialized monitoring equipment (i.e. sound monitoring products). These problems, and exemplary solutions thereto, are discussed in applicant Richard C. Cabot's Audio Engineering Society Convention Paper entitled "Automated Assessment of Surround Sound" (Oct. 9-12, 2009), the disclosure of which is incorporated herein by reference.

Audio Compatibility Assessment System

Compatibility, in particular, has required the interpretation of visual displays and a technical understanding of the effects of signal phase on the downmixing process. The "compatibility problem" has to do with whether media content originally produced with audio for surround sound can be successfully reproduced with stereo audio and/or mono audio. As set forth herein, although at least much of the media content produced today is produced with surround sound audio, the majority of home viewers today will experience the audio in stereo and a nontrivial percentage will hear it in mono. The conversion of surround to stereo or of stereo to mono involves combining channels together, algebraically summing their waveforms. Signals that are present in multiple channels may cancel, or partially cancel, when those channels are combined. If any of these occur, then the audio compatibility suffers.

Figure 4:
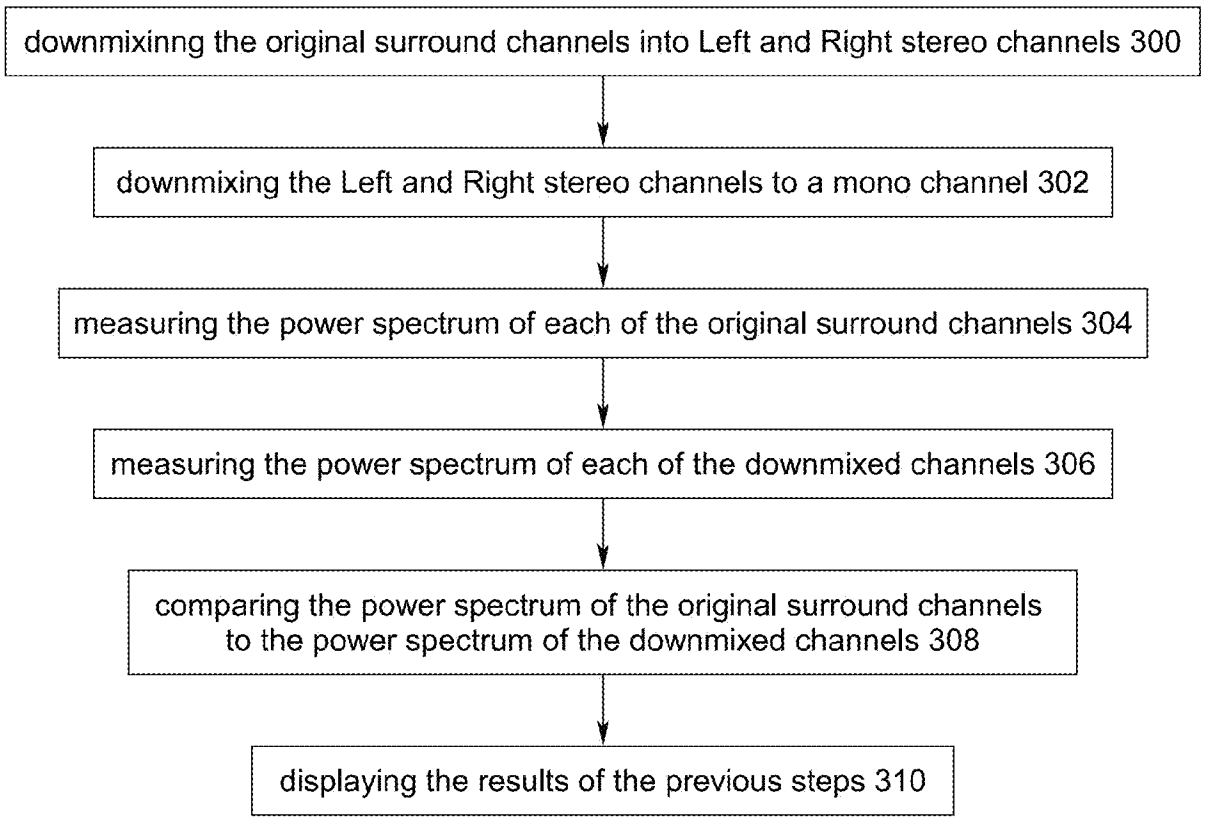
FIG. 4 is a flow chart of exemplary steps of an exemplary audio compatibility method or system.

FIG. 4 is a flow chart of exemplary steps of an exemplary audio compatibility method or system. It will be understood that each block of this flow chart, components of all or some of the blocks of this flow chart, and/or combinations of blocks in this flow chart, may be implemented by software (e.g. coding, software, computer program instructions, software programs, subprograms, or other series of computer-executable or processor-executable instructions), by hardware (e.g. computers, processors, memory), by firmware, and/or a combination of these forms. For example, the steps of downmixing 300 and 302, measuring 304 and 306, comparing 308, and displaying 310 may be implemented by software (e.g. downmixing, measuring, comparing, and displaying programs and/or subprograms stored on a computer readable media and implementable by a processor), by hardware (e.g. downmixers, measurers, comparers, and displays each of which may be implemented as all or part of the audio compatibility assessment system 200, audio monitor 202, and/or display 206), by firmware, and/or a combination of these forms. In the case of software, computer program instructions (computer-readable program code) may be loaded onto a computer to produce a machine (e.g. audio monitor 202), such that the instructions that execute on the computer create structures for implementing the functions specified in the flow chart block or blocks. These computer program instructions may also be stored in a memory that can direct a computer (or an audio monitor 202) to function in a particular manner, such that the instructions stored in the memory produce an article of manufacture including instruction structures that implement the function specified in the flow chart block or blocks. The computer program instructions may also be loaded onto a computer to cause a series of operational steps to be performed on or by the computer to produce a computer implemented process such that the instructions that execute on the computer provide steps for implementing the functions specified in the flow chart block or blocks. The term "loaded onto a computer" also includes being loaded into the memory of the computer or a memory associated with or accessible by the computer. It will also be understood that each block of the flow chart, and combinations of blocks in the flow chart, may be divided and/or joined with other blocks of the flow chart without affecting the scope of the invention. This may result, for example, in computer-readable program code being stored in whole on a single memory, or various components of computer-readable program code being stored on more than one memory.

Figure 5:
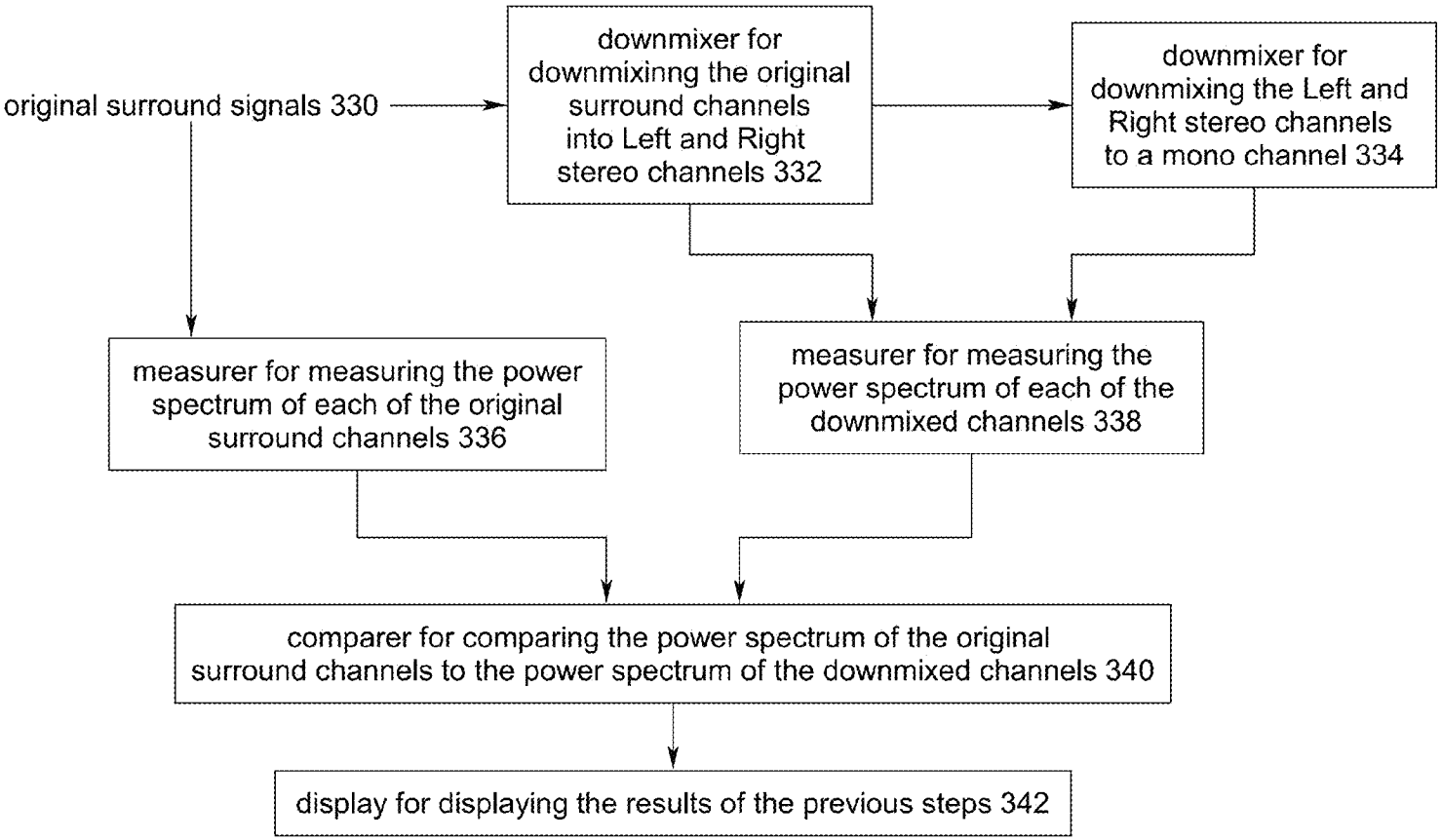
FIG. 5 is a block diagram of an exemplary audio compatibility system or apparatus.

The exemplary steps of an exemplary audio compatibility system 200, as shown in FIG. 4, include the following steps: downmixing the original surround channels into Left and Right stereo channels 300; downmixing the Left and Right stereo channels to a mono channel 302 (or, alternatively, downmixing the original surround channels into a mono channel 302); measuring the power spectrum of each of the original surround channels 304; measuring the power spectrum of each of the downmixed channels 306; comparing the power spectrum of the original surround channels to the power spectrum of the downmixed channels 308; and displaying the results of the previous steps 310. The steps may be implemented on apparatus or system shown in FIG. 5 including the downmixers 332 and 334, the measurers 336 and 338, the comparer 340, and the display 342.

Figure 6:
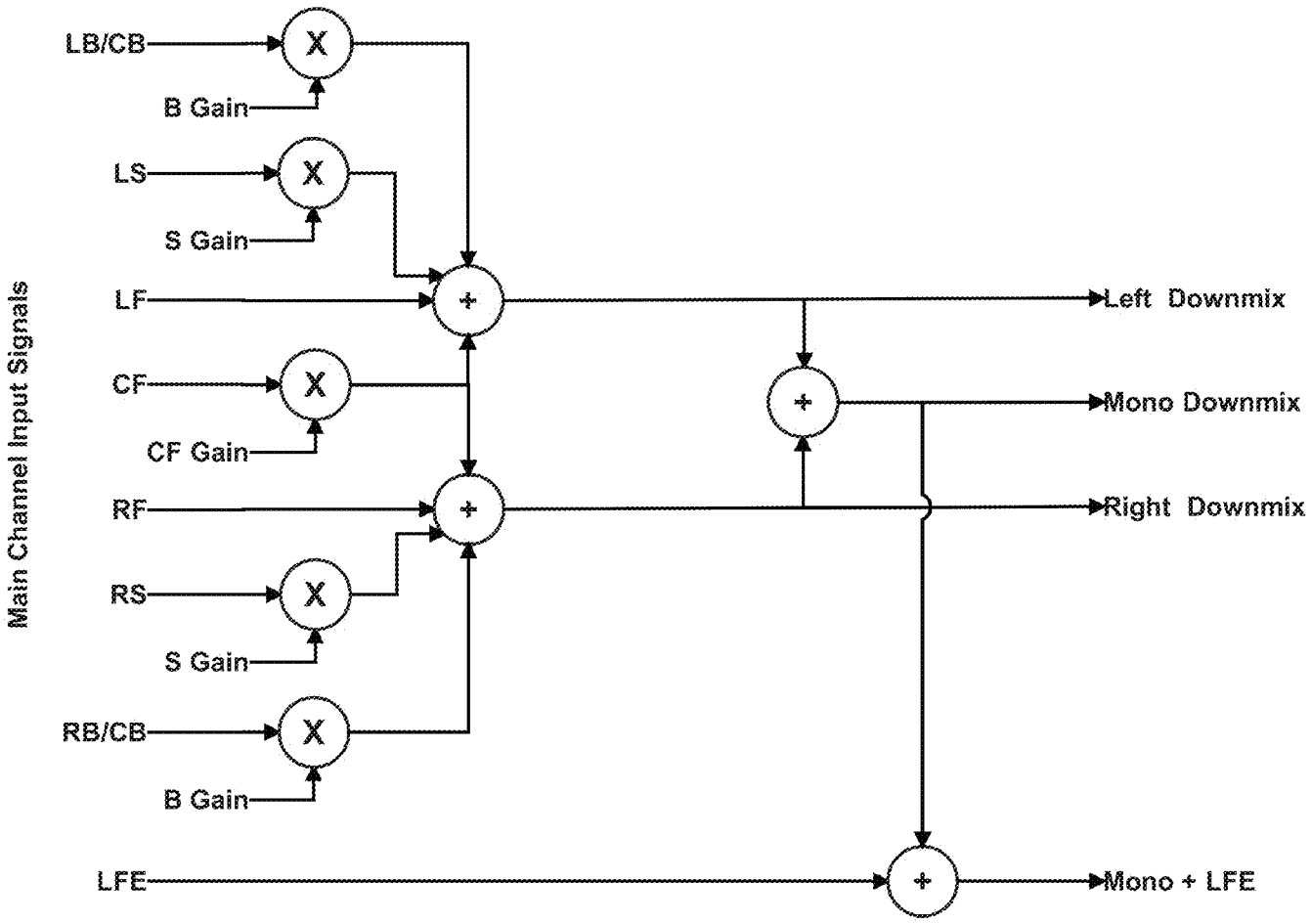
FIG. 6 is a block diagram of an exemplary system for downmix computation.

As shown in FIG. 4, steps 300 and 302, one preferred surround audio compatibility assessment system 200 begins by performing "downmixes." The terms "downmixing" and "downmix" are used to describe the process of manipulating audio where a number of distinct audio channels are mixed together to produce a lower number of channels. Downmixing is sometimes also referred to as fold-down. FIG. 6 graphically shows the original surround channels being downmixed into Left and Right stereo channels 300. (If a channel only carries one signal, it would be equally appropriate to describe the original surround channels being downmixed into Left and Right stereo "signals.") The downmix performed in FIG. 6 is a downmix of the original surround channels into Left and Right stereo channels using the same downmix equations used by the end-user's (the person who will be watching the media content) reproduction equipment. (The downmix equations used by the end-user's reproduction equipment may be contained in metadata traveling with some digital formats (such as Dolby AC3), may be an industry standard, and/or the user may explicitly enter them. FIG. 6 also graphically shows the downmixed Left and Right stereo channels being downmixed to a mono channel 302. U.S. Published Application No. 2004/0032960 to Greisinger, U.S. Pat. No. 7,394,903 to Herre et al., and U.S. Pat. No. 5,946,352 to Rowlands et al. describe downmixing in more detail and to provide examples thereof. These references are herein incorporated by reference in their entirety.

Assuming that the end-user's reproduction equipment operates in an ATSC (Dolby Digital) environment and is converting a 5.1 surround program to stereo or mono, commonly used equations are:

$$L=LF+CF/1.4+LS/1.4 \quad (1)$$

$$R=RF+CF/1.4+RS/1.4 \quad (2)$$

Mono is derived by summing the left and right, giving $$M=LF+RF+CF*1.4+LS/1.4+RS/1.4 \quad (3)$$

Note that, in each case, an overall attenuation is applied (not shown here) to maintain peak levels at unity gain to prevent clipping. The important concept in these equations is that a center channel signal, the typical location for main dialog, is summed into the Left and Right channels with minor change in its gain.

Armed with these three additional downmixed channels (the Left stereo channel, the Right stereo channel, and the mono channel), the challenge becomes comparing the additional downmixed channels to the original surround sound. The fundamental concern is not whether the spatial position of the components will be "correct" in the stereo presentation as compared to the surround presentation. Spatial position is entirely irrelevant in the mono case. Rather, the biggest concern in media content reproduction is whether the audio content will be present at a reasonable approximation to its original level in the surround mix.

Figure 7:
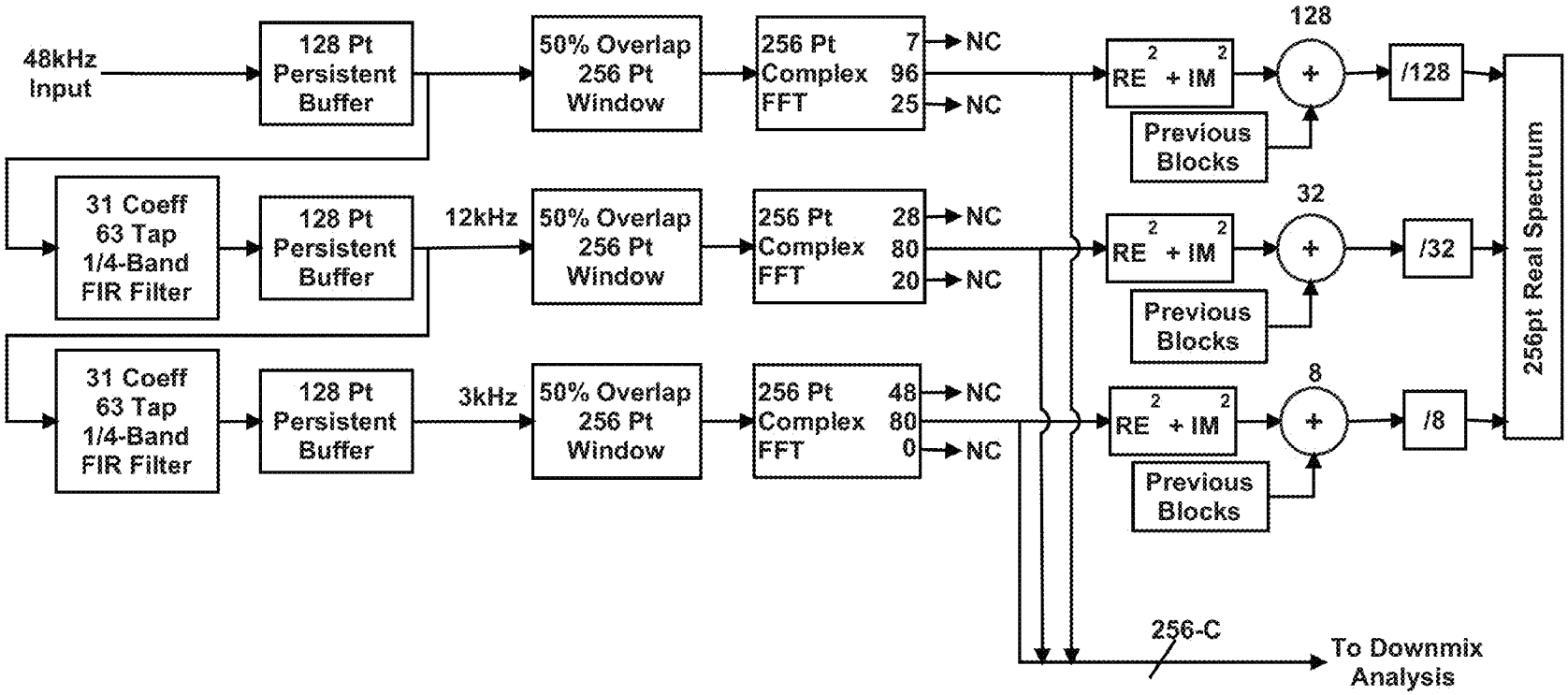
FIG. 7 is a block diagram of an exemplary system for input channel processing.
Figure 8:
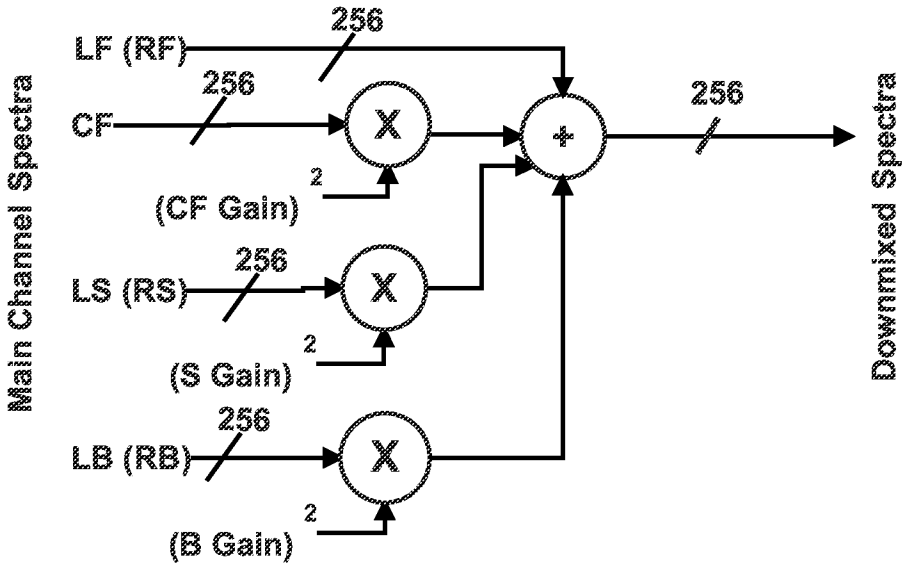
FIG. 8 is a block diagram of an exemplary system for left (L) (or right (R)) downmix channel analysis
Figure 9:
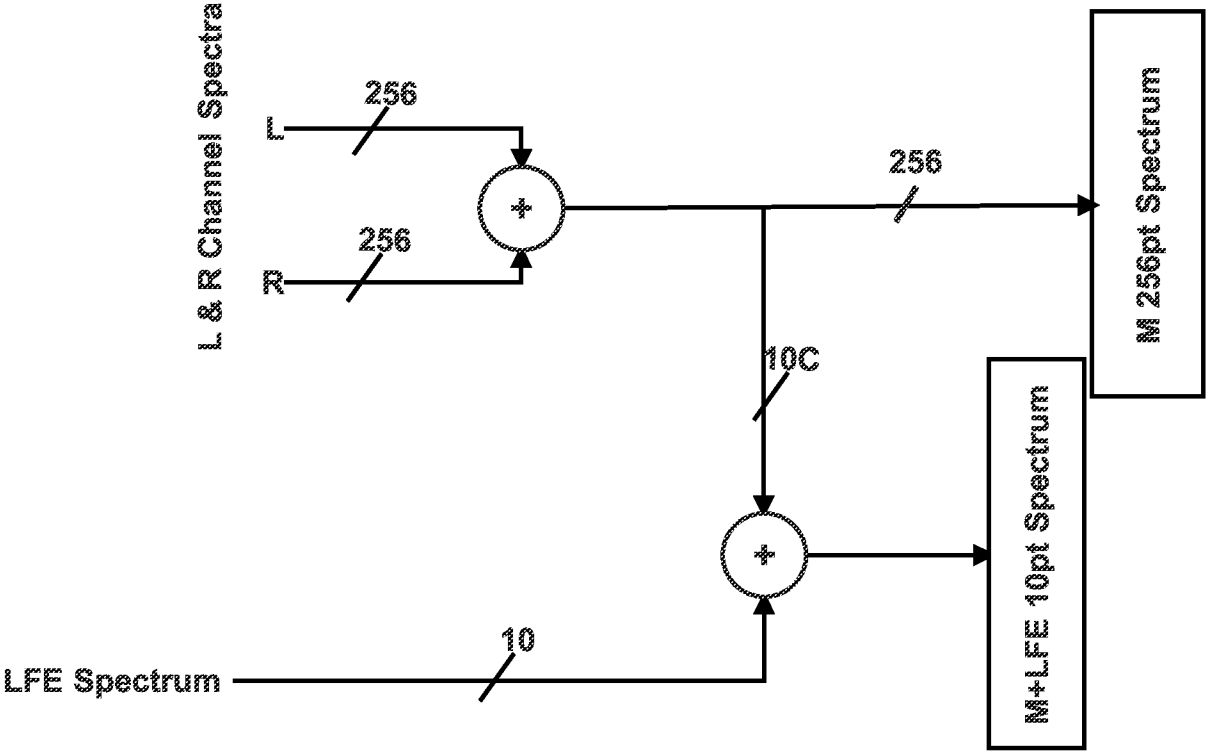
FIG. 9 is a block diagram of an exemplary system for mono and LFE downmix analysis

To address this concern of whether the audio content will be present at a reasonable approximation to its original level in the surround mix, the system 200 measures the power spectrum of each of the original surround channels 304, measures the power spectrum of each of the downmixed channels (the Left stereo channel, the Right stereo channel, and the mono channel) 306; and then compares the sums (with appropriate scaling for the downmix coefficients) of the power spectra of the original surround channels to the power spectra of the downmixed channels 308. Such power spectrum measurement is well known in the art and is typically performed using a Fast Fourier Transform (FFT) and squaring the complex number output values to obtain a set of real numbers representing the power in each frequency band. The frequency domain processing shown in FIG. 7 relates to the measurement of the power spectrum of each of the original surround channels 304. The frequency domain processing is preferably performed in 256 approximately log-spaced bands across the 20 Hz to 20 kHz range. The numbers with diagonal lines in FIG. 7, and subsequent figures, represent the number of components or bins that are passed to subsequent processing. The frequency domain processing shown in FIG. 8 relates to the measurement of the power spectrum of each of the downmixed channels (the Left stereo channel, the Right stereo channel, and the mono channel) 306. The frequency domain processing shown in FIG. 9 relates to the measurement of the power spectrum of the mono channel. The power spectra of the original surround channels are downmixed using the same equations used to obtain the downmix channels (the Left stereo channel, the Right stereo channel, and the mono channel) except for the coefficients whose values are the square of the original downmix coefficients. This is because the system 200 is now combining spectra that are related to the original signals by a square law relationship. It should be noted that these steps may be performed in alternative orders including, but not limited to, the frequency domain processing steps 304 and 306 being performed simultaneously or in the order opposite that which is shown.

The power spectra of the original surround channels are combined (summed). The combination may be performed using any combination of hardware, software, and other technology including those shown and described herein.

The downmixed combined (summed) power spectra of the original surround channels are compared to the power spectra of the downmix channels. (The power spectrum of a signal is frequency selective and removes phase information and, as such, is a convenient way to observe, measure, and compare the content of electronic signals.) The power spectra should be equal. If not, the inequality can only be due to phase related cancellations in the original downmix operation. Since the power spectra of the original surround channels contain no phase information, their downmix contains all energy present in the original audio of the media content. The downmix channels are affected by surround channel phasing and represent what is heard by a viewer with stereo or mono reproduction equipment. Their power spectra represent the energy in the audio when it is reproduced. If these are not identical (there being an inequality), the difference represents the energy in the original audio of the media content that is lost when reproduced in the stereo or mono format.

Since the original goal of the surround audio compatibility assessment system 200 was to automatically detect problems in compatibility, the compatibility measurement must be tested, not just displayed. Since people in charge of monitoring audio will have differing opinions of what constitutes a problem, preferred embodiments of the surround audio compatibility assessment system 200 will have several selectable parameters that may be used to define a problem or "error." In other words, parameters may be selected by those monitoring to define a problem or an "error" and those selected parameters are used by the surround audio compatibility assessment system 200.

The degree of cancellation required to qualify as an error is preferably selectable in 1 dB steps from −1 dB to −15 dB. The frequency range over which this comparison is made is preferably similarly selectable. The comparison may begin at the 63 Hz, 125 Hz, 250 Hz or 500 Hz octave band and end at the 2 kHz, 4 kHz, 8 kHz or 16 kHz octave band. Since these are octave centers, the analysis will extend another 1.4 times lower and higher in frequency, respectively. For example, settings of 500 Hz and 2 kHz will result in analysis from 350 Hz to 2.8 kHz, just covering the voice band.

As with any subjective assessment, duration should be considered. Suppose a program contains a brief instant, perhaps due to shifting positions of actors relative to microphones, in which there is excessive signal cancellation. This is unlikely to significantly affect dialog or to be noticed by viewers. If, however, such cancellation lasted for 30 seconds it most likely would. Consequently the compatibility assessment includes a user selectable duration threshold.

Results and Display

When differences are found between the downmixed combined (summed) power spectra of the original surround channels and the combined (summed) power spectra of the downmix channels, the differences are grouped on an octave basis (centered on 63 Hz, 125 Hz, 250 Hz, 500 Hz, 1 kHz, 2 kHz, 4 kHz, 8 kHz, 16 kHz, but more or less than nine groupings could be used) and presented to the person in charge of monitoring the audio. The grouping is performed solely to reduce the amount of data presented and to make the presentation easier to understand. The grouping may be thought of as putting the difference result of a comparison into a "transform bin" for the associated reported band.

An important aspect in the reporting is the way the frequency domain resolution afforded by the spectral analysis is converted to a lower resolution display for the person in charge of monitoring the audio. The simplest approach is to average the levels of each transform bin contained within the reported band. This, however, tends to underreport the audibility of cancellations that occur. A more revealing technique is to report the peak level of the transform bins within the octave as the cancellation value. This tends, however, to report a value that overestimates the audible degree of cancellation. Another technique is to apply a statistical procedure to the bin levels within each reported band. By computing the level reached by a specified proportion of the transform bins within the band being reported, a more audibly relevant value may be obtained.

The frequency domain processing typically is performed more frequently than it is appropriate to report the results. Frequency domain processing refers to the entire computation of windowing, performing a transform (e.g. a Fast Fourier Transform (FFT) or another mathematical transform into the frequency domain), power computation, summation, differencing, and grouping transform bins for display. The transforms may be performed at a rate that is too high to be visually comprehended by the person in charge of monitoring the audio or at a rate that is too high to be audibly relevant. It is possible to reduce this rate with a nonlinear filter processing successive values out of the repeating transforms. In the preferred embodiment the frequency domain processing is performed with a Fast Fourier Transform (FFT). A 24 Hz frequency domain resolution obtained with an FFT will result in an update rate of approximately 24 transforms per second. This is much faster than the relevant dynamic characteristics of speech or other program material being monitored.

Consider the sequence of values from a single transform bin that result from successive transforms (e.g. Fast Fourier Transforms (FFT)) at this moderately high update rate. The individual values may be processed through a nonlinear digital filter that provides a fast attack time and a slower release time when smoothing the stream of values into a single value for the bin.

Similarly, a temporal masking model may be applied to simulate the characteristics of the human hearing system when processing transient waveforms. These are also well known in the art as applied to low bit-rate audio coding systems. For more information about auditory models, see the following references: Jesteadt et al., "Forward Masking as a Function of Frequency, Masker Level, and Signal Delay," Journal of Acoustical Society of America, 71:950-962, 1982; ITV, Recommendation ITV-R BS 1387, Method for Objective Measurements of Perceived Audio Quality, 1998; and Beerends, "Audio Quality Determination Based on Perceptual Measurement Techniques," Applications of Digital Signal Processing to Audio and Acoustics, Chapter I, Ed. Mark Kahrs, Karlheinz Brandenburg, Kluwer Acad. Publ., 1998." U.S. Pat. No. 7,146,313 to Chen et al. and U.S. Pat. No. 7,313,517 to Beerends et al. describe masking computation in the context of assessing audibility for measurement and their disclosures are herein incorporated by reference.

One challenge for the user of known surround sound monitoring products is watching numerous correlation meters or Lissajous patterns simultaneously. Vendors of such surround sound monitoring products have used various schemes to pack these displays onto a single XY display. All of these schemes take advantage of the redundancy evident in the four quadrants of the Lissajous display. Since the lower half of a Lissajous display offers no additional information compared to the upper half, the display may be truncated or folded at the horizontal axis. Packing five or more of these now truncated displays into a single picture is where the differences between competing displays occur. Some manufacturers use color to provide the additional dimensionality required, others use geometric transformations, and some use both. Several manufacturers have placed additional indicators alongside, above, and below the main multi-channel display in an attempt to adequately represent the multiple phase relationships involved.

Presentation of the results may take several forms depending on the amount of information desired by the user. One display method is shown in the lower half of FIG. 10. The processed difference is shown as a dB reduction from the original level as a function of frequency. The loss in each of the two stereo downmix channels is shown as right and left facing arrowheads, respectively. The mono downmix is shown on the same graph with a diamond shape. If all three are at the same dB value the result is a rectangular shape.

The total spectral energy vs. frequency (the sum of all surround channel spectra, excluding the LFE) is displayed above the compatibility graph. This simplifies assessment of the significance of any signal loss, since low level signals are presumably less important and higher losses of the low level signals may be tolerable.

The frequency detail (shown as 63, 250, 1 k, 4 k, and 16 k) in the compatibility display also aids in assessing the type of content lost in cancellation. If the octaves associated with voice are attenuated (weakened), it is likely that dialog is affected. Low frequencies are typically associated with sound effects and so loss of the low frequencies during stereo reproduction may be more tolerable or even desirable. High frequencies are also associated with effects and may also represent ambience. Again, their attenuation in stereo or mono reproduction is typically of lower concern than loss of dialog.

Figure 10:
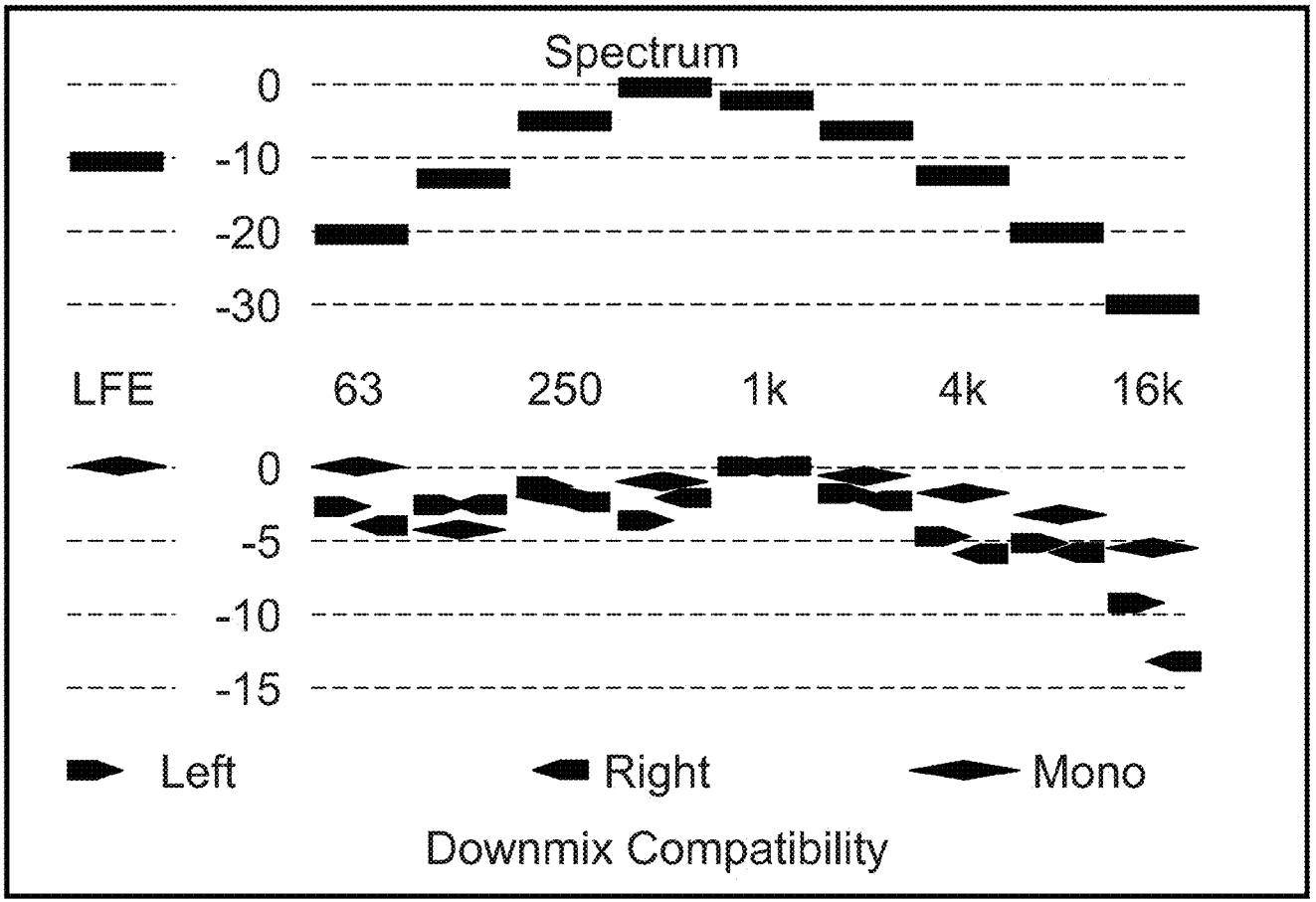
FIG. 10 is an exemplary display generated by a preferred embodiment of the surround audio compatibility assessment method, system, and apparatus described herein.

There is an additional column at the extreme left of FIG. 10 labeled LFE (Low Frequency Effects). Existing downmix implementations always omit the LFE channel. Whether this is advisable is not really open for discussion, LFE information isn't displayed and the user isn't given any control over it. This implies that there aren't any compatibility issues with the LFE channel, but that conclusion is wrong.

A problem rarely considered by users, and to the applicants' knowledge not measured in any commercial product) concerns the compatibility of the LFE channel with the overall surround mix. The limited size of typical home reproduction environments will result in pressure summation of the surround and LFE channels at the user's listening location. Pressure summation refers to the fact that speakers generate pressure waves that, in a small room at low frequencies, can be considered to add linearly. At high frequencies in a small room, or low frequencies in a very large room, the pressure waves can be considered to add on a power basis. This is because the wall reflections do not have the opportunity to significantly alter the phase of the individual speaker signals as they reach the listener when the wavelength of the sound is much larger than the dimensions of the room. When the wavelength is much smaller than the room dimensions, the phase at any individual location becomes unpredictable and so the waveforms can add with unpredictable degrees of cancellation. This is best modeled with a power summation rather than a linear summation. When producing content the mix engineer must keep this pressure summation in mind when assessing the balance of LFE in the mix. To assist this assessment an additional downmix compatibility measurement is performed. Using the same technique described earlier for stereo and mono compatibility, the effect of including the LFE on the mono mix is measured (see FIG. 8). The analysis is restricted to frequencies between 20 Hz and 250 Hz. Though irrelevant to the mono listener, it represents the audible difference between hearing the full mix in a large space such as a theater and in a small space such as a home environment. The spectrum bar above it represents the level in the LFE channel.

DEFINITIONS

Please note that the terms and phrases may have additional definitions and/or examples throughout the specification. Where otherwise not specifically defined, words, phrases, and acronyms are given their ordinary meaning in the art. The following paragraphs provide some of the definitions for terms and phrases used herein.

The term "associated" is defined to mean integral or original, retrofitted, attached, or positioned near. For example, if a display (or other component) is associated with a computer (or other technology), the display may be an original display built into the computer, a display that has been retrofitted into the computer, an attached display that is attached to the computer, and/or a nearby display that is positioned near the computer. For example, the preferred surround audio compatibility assessment system 200 is associated with the audio monitor 202 and the display such that the preferred surround audio compatibility assessment system 200 assesses the compatibility of the input at least one audio signal 204 and the results of the compatibility assessment is displayed on the display.

The terms "computer," "processor," and "processing unit" are defined as devices capable of executing instructions or steps and may be implemented as a programmable logic device or other type of programmable apparatus known or yet to be discovered. These devices may have associated memory. These devices may be implemented using known or yet to be discovered technology including, for example, a general purpose processor (e.g. microprocessor, controller, microcontroller, or state machine), a digital signal processor (DSP), an application specific integrated circuit (ASIC), a field programmable gate array signal (FPGA) or other programmable logic device, discrete gate or transistor logic, discrete hardware components, or any combination thereof designed to perform the functions described herein. Although shown as distinct units, it should be noted that the processing units may be implemented as a plurality of separate processing units. Similarly, multiple processors may be combined.

The term "memory" is defined to include any type of computer (or other technology)-readable media (also referred to as machine-readable storage medium) including, but not limited to attached storage media (e.g. hard disk drives, network disk drives, servers), internal storage media (e.g. RAM, ROM, EPROM, FLASH-EPROM, or any other memory chip or cartridge), removable storage media (e.g. CDs, DVDs, flash drives, memory cards, floppy disks, flexible disks), firmware, and/or other storage media known or yet to be discovered. Although shown as single units, it should be noted that the memories may be implemented as a plurality of separate memories. Similarly, multiple memories may be combined. For example, the first program may be stored in a memory separate from the memory in which the second program is stored. Another example is that, the data used by the first server and/or the data used by the second server may be stored in a distinct memories (not shown) accessible by the servers or the data may be stored in the shared memory would be made accessible by the servers.

It should be noted that the terms "programs" and "subprograms" are defined as a series of instructions that may be implemented as software (i.e. computer program instructions or computer-readable program code) that may be loaded onto a computer to produce a machine, such that the instructions that execute on the computer create structures for implementing the functions described herein or shown in the figures. Further, these programs and subprograms may be loaded onto a computer so that they can direct the computer to function in a particular manner, such that the instructions produce an article of manufacture including instruction structures that implement the function specified in the flow chart block or blocks. The programs and subprograms may also be loaded onto a computer to cause a series of operational steps to be performed on or by the computer to produce a computer implemented process such that the instructions that execute on the computer provide steps for implementing the functions specified in the flow chart block or blocks. The phrase "loaded onto a computer" also includes being loaded into the memory of the computer or a memory associated with or accessible by the computer. The shown programs and subprograms may be divided into multiple modules or may be combined.

It should be noted that the term "may" is used to indicate alternatives and optional features and only should be construed as a limitation if specifically included in the claims.

It should be noted that, unless otherwise specified, the term "or" is used in its nonexclusive form (e.g. "A or B" includes A, B, A and B, or any combination thereof, but it would not have to include all of these possibilities). It should be noted that, unless otherwise specified, "and/or" is used similarly (e.g. "A and/or B" includes A, B, A and B, or any combination thereof, but it would not have to include all of these possibilities). It should be noted that, unless otherwise specified, the term "includes" means "comprises" (e.g. a device that includes or comprises A and B contains A and B but optionally may contain C or additional components other than A and B). It should be noted that, unless otherwise specified, the singular forms "a," "an," and "the" refer to one or more than one, unless the context clearly dictates otherwise.

U.S. patent application Ser. No. 11/408,328 entitled METADATA VERIFICATION IN A SURROUND AUDIO MONITORING SYSTEM, and all the patent and non-patent references cited herein are incorporated by reference in their entirety.

The terms and expressions that have been employed in the foregoing specification are used as terms of description and not of limitation, and are not intended to exclude equivalents of the features shown and described or portions of them.

What is claimed is:

1. A method for performing a surround audio compatibility assessment on a plurality of original surround channels, said method comprising the steps of:

(a) downmixing said original surround channels into Left and Right stereo channels and into a mono channel;

(b) measuring a power spectrum of each of said original surround channels;

(c) combining said power spectrum of each of said original surround channels to create a Left combined power spectrum of said original surround channels, a Right combined power spectrum of said original surround channels, and a combined power spectrum of said original surround channels;

(d) measuring a power spectrum of each of said Left stereo channel, said Right stereo channel, and said mono channel;

(e) comparing power spectra selected from the group consisting of:

(i) said Left combined power spectrum of said original surround channels to said power spectrum of said Left stereo channel, and said Right combined power spectrum of said original surround channels to said power spectrum of said Right stereo channel; and (ii) said combined power spectrum of said original surround channels with said power spectrum of said mono channel; and (f) displaying the results of the previous steps (a)-(e) to facilitate the assessment of signal changes when downmixing multiple audio channels into fewer channels.

2. The method of claim 1, said step of downmixing said original surround channels into Left and Right stereo channels and into a mono channel further comprising the step of downmixing using an end-user's reproduction equipment's downmix equations.

3. The method of claim 1, an inequality found in said comparing step indicating a problem in compatibility.

4. The method of claim 1 further comprising the step of receiving selected parameters that define a problem or an "error."

5. The method of claim 1, said step of displaying the results comprising the steps of:

(a) grouping differences found in said comparing step in transform bins for associated reported frequency bands; and (b) reporting an average level of the transform bins within said frequency bands.

6. The method of claim 1, said step of displaying the results comprising the steps of:

(a) grouping differences found in said comparing step in transform bins for associated reported frequency bands; and (b) reporting a maximum transform bin deviation within said frequency band.

7. The method of claim 1, said step of displaying the results comprising the steps of:

(a) grouping differences found in said comparing step in transform bins for an associated reported frequency bands;

(b) computing levels reached by a specified proportion of said transform bins; and (c) reporting said computed level of each frequency band.

8. A surround audio compatibility assessment system accepting original surround signals, said system comprising:

(a) at least one downmixer accepting original surround signals and downmixing said original surround channels into a Left stereo channel and a Right stereo channel;

(b) a first measurer accepting original surround signals and measuring a power spectrum of each of said original surround channels;

(c) a combiner combining said power spectrum of each of said original surround channels to create a Left combined power spectrum of said original surround channels and a Right combined power spectrum of said original surround channels;

(d) a second measurer accepting said Left stereo channel and said Right stereo channel, and measuring a power spectrum of each of said Left stereo channel and said Right stereo channel;

(e) a comparer accepting said Left and Right combined power spectra of said original surround channels and said power spectra of said Left stereo channel and said Right stereo channel, said comparer comparing said Left combined power spectrum of said original surround channels with said power spectrum of said Left stereo channel, and said comparer comparing said Right combined power spectrum of said original surround channels with said power spectrum of said Right stereo channel; and (f) a display receiving the comparison from said comparer and displaying the results to facilitate the assessment of signal changes when downmixinq multiple audio channels into fewer channels.

9. A method for performing a surround audio compatibility assessment on a plurality of original surround channels, said method comprising the steps of:

(a) downmixing said original surround channels into a Left stereo channel and a Right stereo channel;

(b) measuring a power spectrum of each of said original surround channels;

(c) combining said power spectrum of each of said original surround channels to create a Left combined power spectrum of said original surround channels and a Right combined power spectrum of said original surround channels;

(d) measuring power spectra of each of said Left stereo channel and said Right stereo channel;

(e) comparing said Left combined power spectrum of said original surround channels to said power spectrum of said Left stereo channel, and said Right combined power spectrum of said original surround channels to said power spectrum of said Right stereo channel; and (f) displaying the results of the previous steps (a)-(e) to facilitate the assessment of signal changes when downmixing multiple audio channels into fewer channels.

10. The method of claim 9, said step of downmixing said original surround channels into Left and Right stereo channels further comprising the step of downmixing using an end-user's reproduction equipment's downmix equations.

11. The method of claim 9, an inequality found in said comparing step indicating a problem in compatibility.

12. The method of claim 9 further comprising the step of receiving selected parameters that define a problem or an "error."

13. The method of claim 9, said step of displaying the results comprising the steps of:

(a) grouping differences found in said comparing step in transform bins for associated reported frequency bands; and (b) reporting an average level of the transform bins within said frequency bands.

14. The method of claim 9, said step of displaying the results comprising the steps of:

(a) grouping differences found in said comparing step in transform bins for associated reported frequency bands; and (b) reporting maximum transform bin deviation within said frequency bands.

15. The method of claim 9, said step of displaying the results comprising the steps of:

(a) grouping differences found in said comparing step in transform bins for an associated reported frequency bands;

(b) computing levels reached by a specified proportion of said transform bins; and (c) reporting said computed level of each frequency band.

16. A method for performing a surround audio compatibility assessment on a plurality of original channels, said method comprising the steps of:

(a) downmixing said original channels into a mono channel;

(b) measuring a power spectrum of each of said original channels;

(c) combining said power spectrum of each of said original channels to create a combined power spectrum of said original channels;

(d) measuring a power spectrum of said mono channel;

(e) comparing said combined power spectrum of said original channels with said power spectrum of said mono channel; and (f) displaying the results of the previous steps (a)-(e) to facilitate the assessment of signal changes when downmixinq multiple audio channels into fewer channels.

17. The method of claim 16, said step of downmixing said original channels into a mono channel further comprising the steps of:

(a) downmixing said original channels into Left and Right stereo channels; and (b) downmixing said Left and Right stereo channels into a mono channel.

18. The method of claim 16, said step of downmixing said original surround channels into a mono channel further comprising the steps of:

(a) downmixing said original surround channels into Left and Right stereo channels using an end-user's reproduction equipment's downmix equations; and (b) downmixing said Left and Right stereo channels into a mono channel.

19. The method of claim 16, an inequality between said combined power spectrum of said original channels and said power spectrum of said mono channel indicating a problem in compatibility.

20. The method of claim 16 further comprising the step of receiving selected parameters that define a problem or an "error."

21. The method of claim 16, said step of displaying the results comprising the steps of:

(a) grouping differences found in said comparing step in transform bins for associated reported frequency bands; and (b) reporting an average level of the transform bin within said frequency bands.

22. The method of claim 16, said step of displaying the results comprising the steps of:

(a) grouping differences found in said comparing step in transform bins for associated reported frequency bands; and (b) reporting a maximum transform bin deviation within said frequency band.

23. The method of claim 16, said step of displaying the results comprising the steps of:

(a) grouping differences found in said comparing step in transform bins for an associated reported frequency bands;

(b) computing levels reached by a specified proportion of said transform bins; and (c) reporting said computed level of each frequency band.

* * * * *